US006105173A

United States Patent [19]

Brown

[11] Patent Number: 6,105,173

[45] Date of Patent: Aug. 22, 2000

[54] SOCK SYSTEM

[76] Inventor: Eugene C. Brown, 941 Kane St., Aurora, Ill. 60505

[21] Appl. No.: 09/238,595

[22] Filed: Jan. 28, 1999

[51] Int. Cl.[7] ..... A41B 11/00

[52] U.S. Cl. ..... 2/239; 2/240

[58] Field of Search ..... 2/239, 240, 241, 2/242, 61, 919, 409, 269; D2/980, 983, 993

[56] References Cited

U.S. PATENT DOCUMENTS

| | | | |
|---|---|---|---|
| 319,131 | 6/1885 | Ryer . | |
| 364,650 | 6/1887 | Holmes . | |
| 615,271 | 12/1898 | Hayden et al. . | |
| 1,494,653 | 5/1924 | Walters . | |
| 1,555,752 | 9/1925 | Osborne . | |
| 1,833,163 | 11/1931 | Ischinger . | |
| 3,501,774 | 3/1970 | Norman . | |
| 4,078,266 | 3/1978 | Brown | 2/240 |
| 4,506,392 | 3/1985 | White | 2/239 |
| 4,811,427 | 3/1989 | Regan | 2/466 |
| 5,097,537 | 3/1992 | Ewing | 2/409 |
| 5,453,268 | 9/1995 | Ueno et al. . | |
| 5,608,915 | 3/1997 | Libit | 2/228 |
| 5,926,852 | 7/1999 | Hudy . | |
| 5,953,759 | 9/1999 | Bozzini | 2/409 |

*Primary Examiner*—John J. Calvert
*Assistant Examiner*—Shirra L. Jenkins

[57] ABSTRACT

A sock system for providing a sock for an undyed foot portion and a detachable dyed ankle portion to reduce irritation to a user's foot suffering from a foot malady such as athlete's foot. The sock system includes a foot portion and a least one tubular leg portion. A lower end of the leg portion is detachably attachable to the foot portion around the outer periphery of an opening in the foot portion adjacent the heel end of the foot portion. The foot portion comprising an undyed flexible woven cotton material while the leg portions comprises a dyed fabric material to suit the need of the user.

12 Claims, 2 Drawing Sheets

SOCK SYSTEM

BACKGROUND OF THE INVENTION

1. Field of the Invention

The present invention relates to socks and more particularly pertains to a new sock system for providing a sock for an undyed foot portion and a detachable dyed ankle portion to reduce irritation to a user's foot suffering from a foot malady such as athlete's foot.

2. Description of the Prior Art

The use of socks is known in the prior art. More specifically, socks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,734,938 by Anderson; U.S. Pat. No. 5,511,323 by Dahlgren; U.S. Pat. No. 3,995,322 by Chesebro, Jr.; U.S. Pat. No. 5,483,703 by Williams; U.S. Pat. No. 3,793,851 by Thorneburg; and U.S. Pat. No. 4,615,188 by Hursh et al.

While these devices fulfill their respective, particular objectives and requirements, the aforementioned patents do not disclose a new sock system. The inventive device includes a foot portion and a least one tubular leg portion. A lower end of the leg portion is detachably attachable to the foot portion around the outer periphery of an opening in the foot portion adjacent the heel end of the foot portion. The foot portion comprising an undyed flexible woven cotton material while the leg portions comprises a dyed fabric material to suit the need of the user.

In these respects, the sock system according to the present invention substantially departs from the conventional concepts and designs of the prior art, and in so doing provides an apparatus primarily developed for the purpose of providing a sock for an undyed foot portion and a detachable dyed ankle portion to reduce irritation to a user's foot suffering from a foot malady such as athlete's foot.

SUMMARY OF THE INVENTION

In view of the foregoing disadvantages inherent in the known types of socks now present in the prior art, the present invention provides a new sock system construction wherein the same can be utilized for providing a sock for an undyed foot portion and a detachable dyed ankle portion to reduce irritation to a user's foot suffering from a foot malady such as athlete's foot.

The general purpose of the present invention, which will be described subsequently in greater detail, is to provide a new sock system apparatus and method which has many of the advantages of the socks mentioned heretofore and many novel features that result in a new sock system which is not anticipated, rendered obvious, suggested, or even implied by any of the prior art socks, either alone or in any combination thereof.

To attain this, the present invention generally comprises a foot portion and a least one tubular leg portion. A lower end of the leg portion is detachably attachable to the foot portion around the outer periphery of an opening in the foot portion adjacent the heel end of the foot portion. The foot portion comprising an undyed flexible woven cotton material while the leg portions comprises a dyed fabric material to suit the need of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sock system apparatus and method which has many of the advantages of the socks mentioned heretofore and many novel features that result in a new sock system which is not anticipated, rendered obvious, suggested, or even implied by any of the prior art socks, either alone or in any combination thereof.

It is another object of the present invention to provide a new sock system which may be easily and efficiently manufactured and marketed.

It is a further object of the present invention to provide a new sock system which is of a durable and reliable construction.

An even further object of the present invention is to provide a new sock system which is susceptible of a low cost of manufacture with regard to both materials and labor, and which accordingly is then susceptible of low prices of sale to the consuming public, thereby making such sock system economically available to the buying public.

Still yet another object of the present invention is to provide a new sock system which provides in the apparatuses and methods of the prior art some of the advantages thereof, while simultaneously overcoming some of the disadvantages normally associated therewith.

Still another object of the present invention is to provide a new sock system for providing a sock for an undyed foot portion and a detachable dyed ankle portion to reduce irritation to a user's foot suffering from a foot malady such as athlete's foot.

Yet another object of the present invention is to provide a new sock system which includes a foot portion and a least one tubular leg portion. A lower end of the leg portion is detachably attachable to the foot portion around the outer periphery of an opening in the foot portion adjacent the heel end of the foot portion. The foot portion comprising an undyed flexible woven cotton material while the leg portions comprises a dyed fabric material to suit the need of the user.

Still yet another object of the present invention is to provide a new sock system that lets a user who is required to wear colored socks for a duty or a job to have the portion of the sock covered by the shoe of the user to be made of an undyed fabric material while the exposed portion of the sock may be colored appropriately to suit the needs of the user.

Even still another object of the present invention is to provide a new sock system that may include a medication in the foot portion to treat the foot malady of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
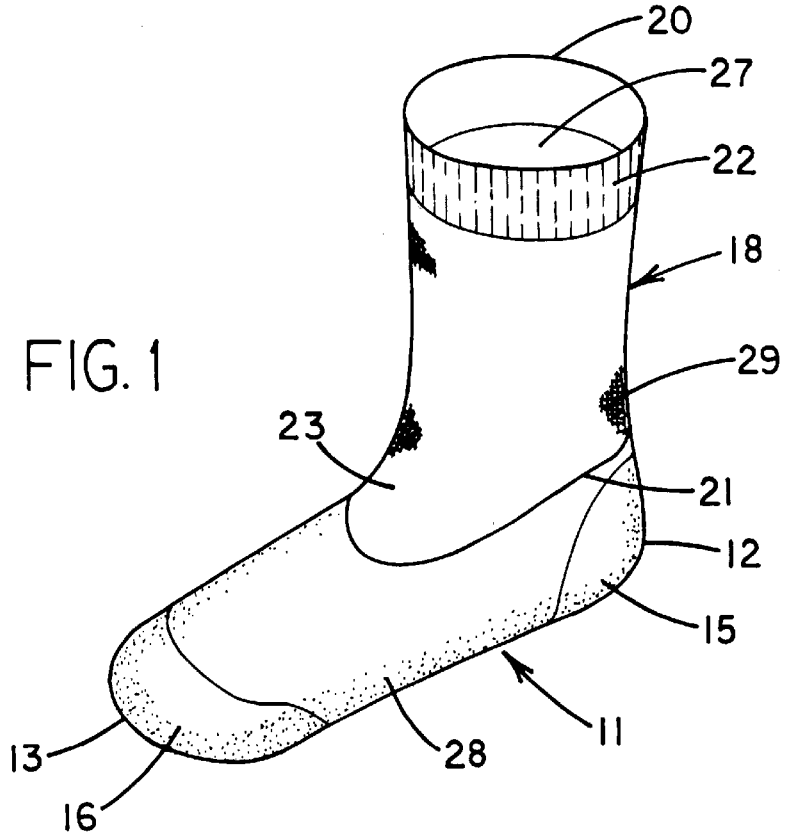
FIG. 1 is a schematic perspective view of an assembled sock of a new sock system according to the present invention.
Figure 2:
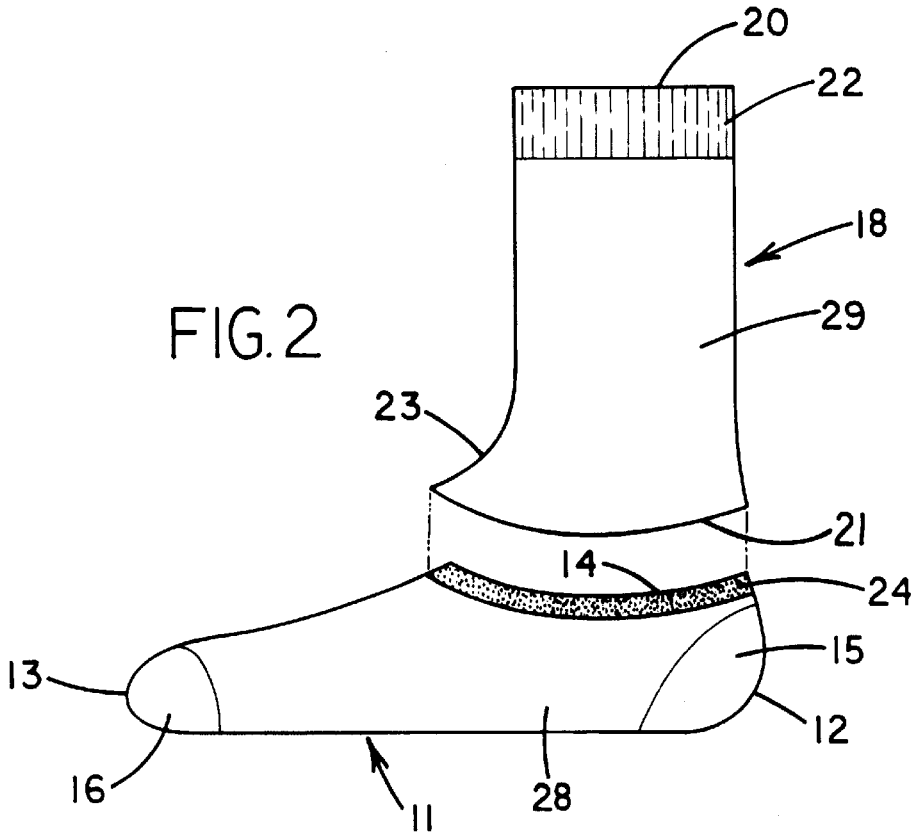
FIG. 2 is a schematic exploded side view of a sock assembled from the present invention.

With reference now to the drawings, and in particular to FIGS. 1 through 4 thereof, a new sock system embodying the principles and concepts of the present invention and generally designated by the reference numeral 10 will be described.

As best illustrated in FIGS. 1 through 4, the sock system 10 generally comprises a foot portion and a least one tubular leg portion. A lower end of the leg portion is detachably attachable to the foot portion around the outer periphery of an opening in the foot portion adjacent the heel end of the foot portion. The foot portion comprising an undyed flexible woven cotton material while the leg portions comprises a dyed fabric material to suit the need of the user.

In closer detail, the sock system 10 comprises a foot portion 11 designed for wear on a foot of user to cover the foot of the user including the toes, heel, sole and instep of the user's foot. The foot portion has opposite heel and toe ends 12,13, and an opening 14 therein adjacent the heel end of the foot portion designed for extending an ankle of the user therethrough. The foot portion ideally has reinforced heel and toe regions 15,16 each having an additional layer of material provided thereon than the rest of the foot portion. The opening of the foot portion preferably has a generally oval outer periphery with a longitudinal axis extending in a direction between the heel and toe ends of the foot portion.

The sock system also includes a plurality of tubular leg portions 17,18,19 each having open upper and lower ends 20,21. In use, the leg portion are designed for extending a lower leg of a user therethrough such that the lower end of the leg portion is positioned adjacent an ankle of the user and the upper end of the leg portion is positioned towards a knee of the user. Each of the leg portions has preferably an elastic band portion 22 therearound adjacent the upper end of the respective leg portion. In use, the elastic band portion of each leg portion is designed for constricting the upper end of the respective leg portion around the leg of a user to hold the upper end of the leg portion in a position on the leg of the user.

The lower end of each of the leg portions has a generally oval outer periphery so that the outer peripheries of the lower end of the leg portions and the opening of the foot portion have dimensions about equal to one another. Preferably, each of the leg portions has a forwardly extending front flared region 23 adjacent the lower end of the leg portion.

Figure 3:
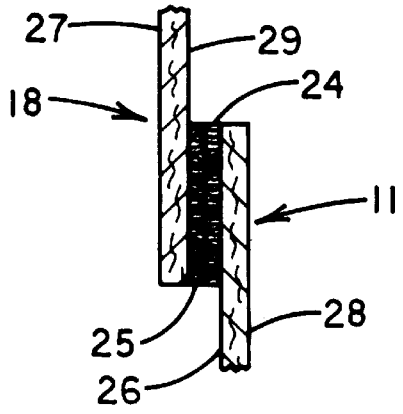
FIG. 3 is an enlarged schematic cross sectional view illustrating the attachment of a leg portion to the foot portion of the present invention.

The foot portion and each leg portion are detachably attachable to one another along attachment portions adjacent to the lower end of the respective leg portion and adjacent the opening of the foot portion. Preferably, a hook and loop fastener detachably attaches the foot portion and the respective leg portion together along the attachment portion adjacent the lower end of the respective leg portion and the attachment portion adjacent the opening of the foot portion. The hook and loop fastener comprises a pair of complementary portions 24,25 detachably attachable to one another. A first of the complementary portions 24 of the hook and loop fastener is provided in a band around the attachment portion adjacent the opening of the foot portion. The leg portions each have a second of the complementary portions 25 provided in a band provided in a band around the attachment portion adjacent the lower end of the respective leg portion. Each of the second complementary portions of the hook and loop fastener on the leg portions is detachably attachable to the first complementary portion of the hook and loop fastener on the foot portion. The foot and leg portions each have inner and outer surfaces 26,27,28,29. The first complementary portion of the hook and loop fastener is provided on the outer surface 28 of the foot portion. The second complementary portions of the hook and loop fastener are provided on the inner surface 27 of the respective leg portion. In an embodiment, as shown in FIG. 3, the portion of the hook and loop fasteners may be provided on the inner surface of the foot portion and the outer surface of the leg portion. Ideally, the bands of hook and loop fastener of the foot and leg portions each have a width about equal to one another to insure that no portion of the hook and loop fastener is in contact with the user's skin to cause additional irritation to the foot and ankle of the user.

Figure 4:
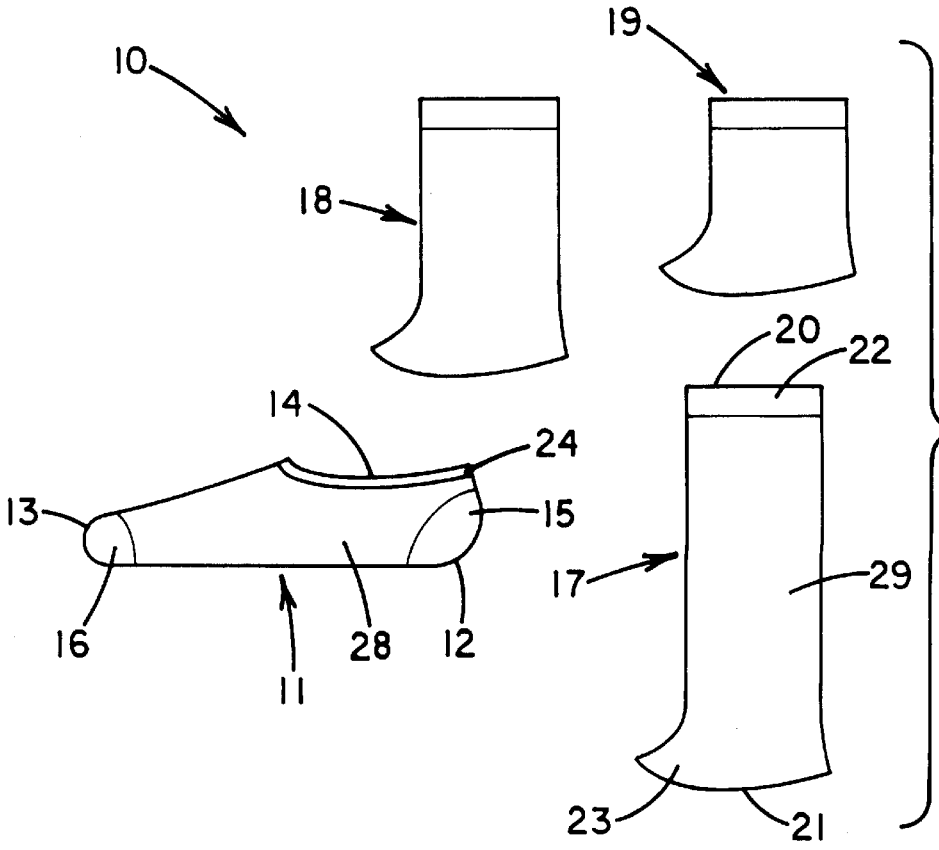
FIG. 4 is a schematic side view of the present invention.

With reference to FIG. 4, each of the leg portions of the sock system has a length defined between the upper and lower ends the respective leg portion. The length of a first of the leg portions 17 designed to go up to the knee of the user is greater than the length of a second of the leg portions 18 designed for going up to mid-calf region of the user's leg. The length of the second leg portion is greater than the length of a third of the leg portions 19 designed for extending just above the ankle of the user. The length of the first leg portion is preferably greater than two times the length of third leg portion. This allows the user to chose the desired length of leg portion to wear according to the needs and desires of the particular user.

The foot portion comprising an undyed flexible woven cotton material and preferably consisting only of an undyed woven cotton material to prevent irritation to the skin of the foot of the user and to provide optimal breathability to the foot portion to ventilate the user's foot. Optionally, the foot portion may have an anti-fungal medicine such as a medicine to treat athletes foot applied thereto. The leg portions each comprise a dyed fabric material colored to suit the needs of the user. The leg portions may be made of any fabric and are not limited to solely cotton materials.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sock system comprising:

a foot portion adapted for wear on a foot of user to cover the foot of the user, said foot portion having opposite heel and toe ends, and an opening therein adjacent said heel end of said foot portion, an attachment portion being positioned adjacent to said opening of said foot portion;

at least one tubular leg portion having open upper and lower ends, said leg portion being adapted for extending a leg of a user therethrough;

said lower end of said leg portions having an attachment portion;

said foot portion and said leg portion being detachably attachable to one another along said attachment portion of said lower end of said leg portion and said attachment portion adjacent said opening of said foot portion;

said foot portion comprising an undyed flexible woven cotton material;

said leg portions comprising a dyed fabric material;

wherein said attachment portion adjacent said opening of said foot portion and said attachment portion of said lower end of said leg portion are each generally oval; and wherein said leg portion has a forwardly extending front flared region adjacent said lower end of said leg portion.

2. The sock system of claim 1, wherein said leg portion has an elastic band portion therearound adjacent said upper end of the respective leg portion.

3. The sock system of claim 1, wherein a hook and loop fastener detachably attaches said foot portion and said leg portion together along said attachment portion of said lower end of said leg portion and said attachment portion adjacent said opening of said foot portion.

4. The sock system of claim 3, wherein said hook and loop fastener comprises a pair of complementary portions detachably attachable to one another, a first of said complementary portions of said hook and loop fastener being provided in a band around said attachment portion adjacent said opening of said foot portion, said leg portion having a second of said complementary portions provided in a band around said attachment portion of said lower end of said leg portion, said second complementary portion of said hook and loop fastener on said leg portion being detachably attachable to said first complementary portion of said hook and loop fastener on said loot portion.

5. The sock system of claim 4, wherein said foot and leg portions each have inner and outer surfaces, said first complementary portion of said hook and loop fastener being provided on said outer surface of said foot portion, said second complementary portion of said hook and loop fastener being provided on said inner surface of said leg portion.

6. A sock system, comprising:

a foot portion adapted for wear on a foot of user to cover the foot of the user, said foot portion having opposite heel and toe ends, and an opening therein adjacent said heel end of said foot portion;

an attachment portion being positioned adjacent to said opening of said foot portion, said opening of said foot portion having a generally oval outer periphery, said attachment portion of said foot portion having a longitudinal axis extending in a direction between said heel and toe ends of said foot portion;

a plurality of tubular leg portions each having open upper and lower ends, said leg portion being adapted for extending a lower leg of a user therethrough such that said lower end of said leg portion is positioned adjacent an ankle of the user and said upper end of said leg portion is positioned towards a knee of the user;

each of said leg portions having an elastic band portion therearound adjacent said upper end of the respective leg portion, said elastic band portion of each leg portion being adapted for constricting said upper end of the respective leg portion around the leg of a user to hold said upper end of said leg portion in a position on said leg of the user;

said lower end of each of said leg portions having a generally oval attachment portion, said attachment portion of said lower end of said leg portion and said attachment portion of said foot portion having dimensions about equal to one another;

each of said leg portions having a forwardly extending front flared region adjacent said lower end of said leg portion; said foot portion and each leg portion being detachably attachable to one another along said attachment portion of said lower end of the respective leg portion and said attachment portion of said foot portion;

wherein a hook and loop fastener detachably attaches said foot portion and the respective leg portion together along said attachment portion of said lower end of the respective leg portion and said attachment portion of said foot portion;

said hook and loop fastener comprising a pair of complementary portions detachably attachable to one another;

a first of said complementary portions of said hook and loop fastener being provided in a band around said attachment portion of said foot portion;

said leg portions each having a second of said complementary portions provided in a band around said attachment portion of the lower end of the respective leg portion;

each of said second complementary portions of said hook and loop fastener on said leg portions being detachably attachable to said first complementary portion of said hook and loop fastener on said foot portion;

said foot and leg portions each having inner and outer surfaces, said first complementary portion of said hook and loop fastener being provided on said outer surface of said foot portion, said second complementary portions of said hook and loop fastener being provided on said inner surface of the respective leg portion;

each of said leg portions having a length defined between said upper and lower ends the respective leg portion;

said length of a first of said leg portions being greater than said length of a second of said leg portions, said length of said second leg portion being greater than said length of a third of said leg portions, said length of said first leg portion being greater than two times said length of third leg portion;

said foot portion comprising an undyed flexible woven cotton material; and said leg portions comprising a dyed fabric material.

7. A sock system, comprising:

a foot portion adapted for wear on a foot of user to cover the foot of the user, said foot portion having opposite heel and toe ends, and an opening therein adjacent said heel end of said foot portion, an attachment portion being positioned adjacent to said opening of said foot portion;

at least one tubular leg portion having open upper and lower ends, said leg portion being adapted for extending a leg of a user therethrough;

said lower end of said leg portions having an attachment portion;

said foot portion and said leg portion being detachably attachable to one another along said attachment portion of said lower end of said leg portion and said attachment portion adjacent said opening of said foot portion;

said foot portion comprising an undyed flexible woven cotton material;

said leg portions comprising a dyed fabric material; and wherein said leg portion has a forwardly extending front flared region adjacent said lower end of said leg portion.

8. The sock system of claim 7, wherein said outer peripheries of said opening of said foot portion and said lower end of said leg portion are each generally oval.

9. The sock system of claim 7, wherein said leg portion has an elastic band portion therearound adjacent said upper end of the respective leg portion.

10. The sock system of claim 7, wherein a hook and loop fastener detachably attaches said foot portion and said leg portion together along said outer peripheries of said lower end of said leg portion and said opening of said foot portion.

11. The sock system of claim 11, wherein said hook and loop fastener comprises a pair of complementary portions detachably attachable to one another, a first of said complementary portions of said hook and loop fastener being provided in a band around said outer periphery of said opening of said foot portion, said leg portion having a second of said complementary portions provided in a band provided in a band around said outer periphery of said lower end of said leg portion, said second complementary portion of said hook and loop fastener on said leg portion being detachably attachable to said first complementary portion of said hook and loop fastener on said foot portion.

12. The sock system of claim 11, wherein said foot and leg portions each have inner and outer surfaces, said first complementary portion of said hook and loop fastener being provided on said outer surface of said foot portion, said second complementary portion of said hook and loop fastener being provided on said inner surface of said leg portion.

* * * * *